United States Patent [19]

Latta et al.

[11] 4,008,044

[45] Feb. 15, 1977

[54] TREATMENT OF POLYESTER TEXTILES TO IMPROVE SOIL RELEASE AND WETTABILITY PROPERTIES

[75] Inventors: Bruce M. Latta, Bloomingdale; Ildo E. Pensa, Palisades Park, both of N.J.

[73] Assignee: J. P. Stevens & Co., Inc., New York, N.Y.

[22] Filed: June 3, 1975

[21] Appl. No.: 583,499

[52] U.S. Cl. ..... 8/115.5; 8/DIG. 4

[51] Int. Cl.[2] ..... D06M 1/10

[58] Field of Search ..... 8/115.5, DIG. 4

[56] References Cited

UNITED STATES PATENTS

| | | | |
|---|---|---|---|
| 2,828,528 | 4/1958 | Gajjar | 28/76 |
| 2,998,296 | 8/1961 | Henneman | 8/115.5 |
| 3,135,577 | 6/1964 | Watson | 8/115.5 |
| 3,535,141 | 10/1970 | Marco | 117/47 |

FOREIGN PATENTS OR APPLICATIONS

| | | | |
|---|---|---|---|
| 818,121 | 8/1959 | United Kingdom | 8/DIG. 4 |

OTHER PUBLICATIONS

American Assoc. of Textile Chemist and Colorist, vol. I, No. 2, pp. 50–51, 1969.

*Primary Examiner*—John Kight, III

*Attorney, Agent, or Firm*—Michael T. Frimer; Charles Stein

[57] ABSTRACT

This invention relates to a process for improving the soil release and wetting properties of a polyester textile material by applying thereto a limited amount of an aqueous solution containing about 0.5 to 2.5% by weight of sodium hydroxide and then contacting the textile material with steam while maintaining a moisture content of at least 35% to remove 0.4 to 2.5% by weight of the polyester. By using this procedure the amount of polyester removed is controlled by the limited amount of sodium hydroxide present while at the same time a substantially uniform product is obtained.

2 Claims, No Drawings

TREATMENT OF POLYESTER TEXTILES TO IMPROVE SOIL RELEASE AND WETTABILITY PROPERTIES

BACKGROUND OF THE INVENTION

This invention relates to the treatment of polyester textiles with sodium hydroxide solution to improve the soil release and wettability properties using a procedure in which the amount of polyester removed is relatively small and is controlled by the limited amount of sodium hydroxide present on the fibers.

It is known that polyester textile materials such as fabrics can be treated with aqueous solutions of sodium hydroxide to dissolve a portion of the polyester and improve a number of the properties of the textile material. Typical prior art includes U.S. Pat. No. 2,590,402; 2,781,242; 2,828,528; 3,135,577; 3,535,141; U.S. Defensive Publication 273,566; Journal of the American Association of Textile Chemists and Colorists, October 1971, pages 219–223; and Textile Research Journal, September 1971, pages 732–735. Among the properties which are disclosed as being improved are hand, soil release and wettability.

A number of different methods of treating fabric with aqueous solutions of sodium hydroxide are disclosed by the prior art. In one method the fabric is immersed in a hot solution of sodium hydroxide. As indicated in U.S. Pat. No. 2,590,402, one of the characteristics of this process is that the percent loss in weight of the polyester fabric is directly proportional to the time of treatment. Thus, when the treatment is carried out continuously by feeding the polyester fabric through a bath, any change in the residence time, such as caused by temporary stoppage of the equipment, results in a non-uniform product. Additionally, since the reaction is carried out in the treatment bath, this bath becomes contaminated with dissolved polyester, greige oils, etc. and must be periodically replaced. As also disclosed in U.S. Pat. No. 2,590,402, there is a loss in fabric strength which is proportional to the amount of polyester removed. Removal from the product of substantial amounts of polyester is also undesirable from an economic point of view since the polyester lost represents wasted material.

In Defensive Publication 273,566, fabric is treated with hot sodium hydroxide solution for a period of time, e.g., 5 minutes at 90°C. in the Example, and then the fabric is removed from the treatment bath and heated while it still contains sodium hydroxide solution, e.g., in the example, the fabric is dried in an oven at 105° C. for 5 minutes. Such drying of polyester fabric can cause the sodium hydroxide solution to migrate to the folds and edges of the fabric giving a product which is not only non-uniform, but which may be chemically damaged in the areas of high sodium hydroxide concentration.

U.S. Pat. No. 3,535,141 discloses a process for imparting soil release properties to polyester fabric in which the fabric is first treated with a sodium hydroxide solution and then a soil release resin is applied. In Examples VII to XVII there is disclosed the treatment of Dacron/cotton blended fabrics with sodium hydroxide solution in a steam atmosphere before application of the soil release resin. The use of steam in a sodium hydroxide treatment of polyester/cotton blended fabric is also disclosed in the above-mentioned Journal of the American Association of Textile Chemists and Colorists article which shows the application of aqueous 5% sodium hydroxide solution to a blended fabric followed by steaming for from two to 64 minutes. There is no disclosure in these references of controlling the amount of polyester removed by having only a limited amount of sodium hydroxide on the fabric when the reaction therewith takes place and the cotton fibers in the blended fabrics of the references would interfere with efforts to obtain such control since large amounts of the sodium hydroxide solutions would be held by the cotton.

SUMMARY OF THE INVENTION

In accordance with this invention, it has been determined that the soil release and wettability properties of polyester textile material can be substantially improved when only small amounts of polyester have been removed by treatment with sodium hydroxide solution, thus minimizing the losses of strength and textile weight. The present invention provides a continuous process for treating polyester textile material in which a uniform product is obtained and only a limited amount of NaOH is present to react with the textile material so that increases in the treatment time will have only a minimal effect on the amount of polyester removed.

A 0.5 to 2.5% solution of NaOH in water is applied to polyester textile material at a wet pickup (i.e., weight of solution applied/weight of dry textile material) of 70 to 90%. The material with solution thereon is then moved through a steam treatment chamber so that the residence time of each portion of the textile is between about 10 to 90 minutes. The moisture content of the textile material is maintained at a minimum of 35%, while the material is within the steam chamber. After the material is removed from the steam it is washed to remove any unreacted sodium hydroxide and hydrolysis products.

DETAILED DESCRIPTION OF THE INVENTION

Polyester Textile material is continuously impregnated with a dilute solution of NaOH in water containing about 0.50 to 2.5% by weight of the NaOH. Preferably, the solution contains about 0.75 to 1.5% by weight of NaOH. The impregnation can be carried out with a padder or by any other conventional procedure for applying a solution to a fabric. The wet pickup of the solution is maintained within the range of about 70 to 90%. By controlling the wet pickup and the solution concentration there is only a limited amount of NaOH on the polyester textile after impregnation which can react with the textile during the subsequent steaming.

After application of the NaOH solution, the wet textile is moved through a steam chamber. The moisture content of all parts of the textile while the steam chamber is maintained at a minimum of about 35% by weight. If the moisture content decreases to less than 35%, this can cause migration of the sodium hydroxide solution which gives a non-uniform product with possible damage to the textile material in the areas of high sodium hydroxide concentration. To ensure that the moisture content does not drop below 35%, the steam applied should be saturated or substantially saturated. It is preferable that the amount of water present on all portions of the textile material be at least equal to one-half the amount of sodium hydroxide solution applied thereto. It is also preferable that the moisture content of the textile while in the steam chamber not exceed 120% or the sodium hydroxide solution will become too dilute and the desired reaction with the polyester will be slowed greatly. Additionally, if the moisture content is too high, water may be squeezed out of the textile resulting in a bath type environment rather than a steam environment.

Since some water may condense on the textile material during steaming, the amount of treating solution on the material entering the steam chamber should preferably not exceed about 90% of the weight of the material in order to ensure that the moisture content of the material within the steam chamber does not exceed 120% by weight. When a J-box steamer is used if the moisture content of the textile material exceeds about 120%, water is expressed from the material and collects at the bottom of the J-box resulting in a bath type treatment in which the sodium hydroxide is greatly diluted thus slowing the reaction. At the same time fresh caustic can reach the fiber surfaces eliminating the self-limiting feature of the process.

The textile material which is treated should be made entirely of polyester rather than a blend of polyester with another fiber such as cotton. If the present process is carried out on a polyester/cotton fabric such as used in the above-mentioned American Association of Textile Chemists and Colorists article, a great deal of the caustic solution is held by the cotton and thus controlled and self-limiting reactions in which most or all of the sodium hydroxide reacts with the polyester are not obtained.

In order to react most of the NaOH, the textile material should be contacted with steam for at least 10 minutes. Preferably the steam treatment is carried out for a period of 10 to 90 minutes. A minimum of about 0.4% of the polyester in the textile material should be dissolved to obtain the desired soil release and wettability properties. To prevent undue strength and material losses, not more than 2.5% of the polyester should be removed.

The textile material treated by the present process can be in the form of fibers, yarns or fabrics.

EXAMPLE

A 100% polyester double knit fabric weighing about 7.0 ounces per square yard was passed through a pad bath containing a 1.25% by weight of solution of NaOH in water. The pressure of the pad rollers was set to give a wet pickup of 85%. The fabric was fed from the padder into a J-box steam chamber where the fabric was contacted with saturated steam. The feed rate through the J-box was adjusted so that the residence time was 20 minutes. This gave a weight loss of polyester of about 0.50% by weight. The fabric from the J-box was passed through a three-zone washer in which it was washed with water at 120° F., 95° F., and 95° F.

The above procedure was repeated with additional samples adjusting the residence time in the steam chamber to periods of 35 minutes and 70 minutes. The weight losses of polyester were 0.50 and 0.58% by weight respectively.

All the treated fabrics had excellent soil release, soil redeposition, wetting and wicking properties. Stains of corn oil, mayonnaise, butter and peanut butter were completely removed in one washing. No soil redeposition was found by the Celanese Redeposition Test. The fabrics all wet out in less than 10 seconds and wicked water more than 1.5 inches in two minutes.

It will be apparent that many modifications and variations can be effected without departing from the scope of the novel concepts of the present invention and the illustrative details disclosed are not to be construed as imposing undue limitations on the invention.

We claim:

1. A continuous process for imparting soil release properties to fabric consisting essentially of polyester, said process comprising A. Applying to said fabric about 70 to 90% by weight based on the weight of said fabric of an aqueous solution containing 0.5 to 2.5% by weight of NaOH, B. Contacting said fabric having said aqueous solution thereon with saturated steam for a period of 10 to 90 minutes while maintaining the moisture content of the fabric within the range of 35 to 120% by weight based on the weight of the fabric to remove about 0.4 to 2.5% by weight of the polyester in the fabric and C. Washing said fabric with water to remove any unreacted NaOH.

2. A process as claimed in claim 1 wherein said aqueous solution contains about 0.75 to 1.5% by weight of NaOH.

* * * * *